US008043078B2

(12) United States Patent
Stover et al.

(10) Patent No.: US 8,043,078 B2
(45) Date of Patent: Oct. 25, 2011

(54) COMPRESSOR SEALING ARRANGEMENT

(75) Inventors: Robert C. Stover, Versailles, OH (US); Huaming Guo, Suzhou New District (CN); Minghau Yan, Suzhou SIP (CN); Jun You, Suzhou (CN); Yong Cao, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 503 days.

(21) Appl. No.: 12/207,051

(22) Filed: Sep. 9, 2008

(65) Prior Publication Data

US 2009/0068048 A1 Mar. 12, 2009

Related U.S. Application Data

(60) Provisional application No. 60/993,464, filed on Sep. 11, 2007, provisional application No. 61/038,162, filed on Mar. 20, 2008.

(51) Int. Cl.
*F03C 4/00* (2006.01)
*F04C 18/00* (2006.01)
*F04C 2/00* (2006.01)

(52) U.S. Cl. ..... 418/55.4; 418/55.5; 418/57; 418/104; 418/144

(58) Field of Classification Search ..... 418/55.1–55.6, 418/57, 104, 122, 128, 140–144
See application file for complete search history.

(56) References Cited

U.S. PATENT DOCUMENTS

| | | | | |
|---|---|---|---|---|
| 5,447,418 | A | 9/1995 | Takeda et al. | |
| 5,487,653 | A * | 1/1996 | Lee | 418/55.4 |
| 6,095,764 | A | 8/2000 | Shibamoto et al. | |
| 6,537,044 | B2 * | 3/2003 | Chang et al. | 418/55.4 |
| 6,679,683 | B2 * | 1/2004 | Seibel et al. | 418/55.4 |

FOREIGN PATENT DOCUMENTS

| | | |
|---|---|---|
| JP | 07063173 | 3/1995 |
| JP | 09317667 | 12/1997 |
| JP | 11022660 | 1/1999 |
| JP | 2001082354 | 3/2001 |
| JP | 2003065255 | 3/2003 |
| KR | 1019990060803 | 7/1999 |
| KR | 1020010035761 | 5/2001 |
| KR | 1020020030018 | 4/2002 |

OTHER PUBLICATIONS

International Search Report regarding International Application No. PCT/US2008/010623 dated Feb. 26, 2009.

(Continued)

*Primary Examiner* — Theresa Trieu
(74) *Attorney, Agent, or Firm* — Harness, Dickey & Pierce, P.L.C.

(57) ABSTRACT

A compressor may include a shell, first and second scroll members, a partition and a first annular seal. The partition may be fixed to the shell and may overly the first scroll member. The partition may include first and second sides having a second discharge opening passing therethrough and being in communication with the first discharge opening. The first side may include a protrusion extending toward the first scroll member and generally surrounding the second discharge opening. The first annular seal may sealingly engage the partition and may be displaceable radially inward to a position abutting the protrusion to limit a radially inward travel of the first annular seal.

28 Claims, 6 Drawing Sheets

OTHER PUBLICATIONS

Written Opinion of the International Searching Authority regarding International Application No. PCT/US2008/010623 dated Feb. 26, 2009.

International Preliminary Report on Patentability regarding International Application No. PCT/US2008/010623 dated Mar. 16, 2010.

International Search Report regarding International Application No. PCT/US2008/010597 dated Feb. 19, 2009.

Written Opinion of the International Searching Authority regarding International Application No. PCT/US2008/010597 dated Feb. 19, 2009.

* cited by examiner

COMPRESSOR SEALING ARRANGEMENT

CROSS-REFERENCE TO RELATED APPLICATIONS

This application claims the benefit of U.S. Provisional Application Nos. 60/993,451, 60/993,452, 60/993,464 and 60/993,465, each filed on Sep. 11, 2007 and U.S. Provisional Application No. 61/038,162, filed Mar. 20, 2008. The entire disclosures of each of the above applications are incorporated herein by reference.

FIELD

The present disclosure relates to compressors, and more specifically to sealing arrangements for compressors.

BACKGROUND

This section provides background information related to the present disclosure which is not necessarily prior art.

A scroll compressor may include a non-orbiting scroll member mounted for axial displacement relative to an orbiting scroll member. A sealing arrangement may be used to isolate a discharge passage in the non-orbiting scroll member from lower pressure regions of the compressor. However, depending on pressure differentials experienced during compressor operation, the sealing arrangement may be forced radially inward toward the discharge passage.

SUMMARY

This section provides a general summary of the disclosure, and is not a comprehensive disclosure of its full scope or all of its features.

A compressor may include a shell, first and second scroll members, a partition and a first annular seal. The first scroll member may be supported within the shell for axial displacement relative to the shell. The first scroll member may include a first end plate defining a first discharge opening and having a first spiral wrap extending from a first surface thereof. The second scroll member may be supported within the shell and may include a second end plate having a second spiral wrap extending therefrom and meshingly engaged with the first spiral wrap. The partition may be fixed to the shell and may overly the first scroll member. The partition may include first and second sides having a second discharge opening passing therethrough and being in communication with the first discharge opening. The first side may generally face the first scroll member and may include a protrusion extending toward the first scroll member and generally surrounding the second discharge opening. The first annular seal may sealingly engage the first scroll member and the first side of the partition to define first and second pressure regions within the shell. The first annular seal may generally surround and may be disposed radially outwardly relative to the protrusion on the partition. The first annular seal may be displaceable to a position abutting the protrusion and the protrusion may limit a radially inward travel of the first annular seal.

The first scroll member may include a second surface generally opposite the first surface including a recess formed therein, the recess including an outer wall generally surrounding the protrusion on the partition and engaged with a radially outer portion of the first annular seal. The first annular seal may include a generally L-shaped cross-section including first and second legs. The first leg may extend generally longitudinally between the first scroll member and the partition and may be sealingly engaged with the outer wall of the recess. The second leg may extend radially inwardly from the first leg and may sealingly engage the partition. The second leg may include a free end engaged with the protrusion when the second leg is displaced radially inwardly.

The first pressure region may be located radially outwardly from and may generally surround the second pressure region.

The first pressure region may include a suction pressure region of the shell.

The second pressure region may include an intermediate pressure region operating at a pressure between an operating pressure of a suction pressure region and an operating pressure of a discharge pressure region within the shell.

The second annular seal may be disposed radially inwardly relative to the first annular seal and may be sealingly engaged with the first scroll member and the first side of the partition to define a third pressure region. The third pressure region may include a discharge pressure region of the shell.

An alternate compressor may include a shell, first and second scroll members, a partition, and a first annular seal. The first scroll member may be supported within the shell and may include a first end plate defining a first discharge opening and having a first spiral wrap extending from a first surface thereof. The second scroll member may be supported within the shell and may include a second end plate having a second spiral wrap extending therefrom and meshingly engaged with the first spiral wrap. The partition may be fixed to the shell and may overly the first scroll member. The partition may include a second discharge opening in communication with the first discharge opening. The first annular seal may seal first and second pressure regions of the shell from communication with one another. The first annular seal may include a first portion sealingly engaged with the partition and a second portion engaged with the first scroll member. The first annular seal may include a fluid communication passage in communication with the first pressure region. The second portion may be displaceable between first and second positions and may be sealingly engaged with the first scroll member to seal the first pressure region from communication with the second pressure region when in the first position. The second portion may be displaced relative to the first scroll member when in the second position to provide fluid communication between the fluid communication passage and the second pressure region.

The fluid communication passage may be isolated from the second pressure region when the second portion of the seal is in the first position. The second portion of the first annular seal may sealingly engage a wall formed on the first scroll member generally surrounding the first pressure region to isolate the fluid communication passage from the second pressure region.

The first annular seal may include a generally L-shaped cross-section including first and second legs, the first leg extending generally longitudinally between the first scroll member and the partition and the second leg extending radially inwardly toward the first pressure region from a first end of the first leg proximate the partition. The first leg may form the second portion of the first annular seal and the second leg may form the first portion of the first annular seal.

The fluid communication passage in the first annular seal may include a recess formed in a second end of the first leg proximate the first scroll member. The fluid communication passage may further provide fluid communication between the first and second pressure regions when the second portion of the first annular seal is in the second position.

The first position may generally correspond to a first operating condition where an operating pressure within the second pressure region is less than an operating pressure within the first pressure region.

The second position may generally correspond to a second operating condition where an operating pressure within the second pressure region is greater than an operating pressure within the first pressure region.

The second pressure region may be located radially outwardly from and may generally surround the first pressure region.

The first pressure region may include a discharge passage defined between the first and second discharge openings. The second pressure region may include a region of the shell external to the discharge passage.

The second pressure region may include an intermediate pressure region operating at a pressure between an operating pressure of a suction pressure region and an operating pressure of a discharge pressure region within the shell.

The second annular seal may be disposed radially outwardly relative to the first annular seal to seal a third pressure region of the shell from communication with the second pressure region. The third pressure region may include a suction pressure region of the shell.

An alternate compressor may include a shell, first and second scroll members, a partition, and a first annular seal. The first scroll member may be supported within the shell for axial displacement relative to the shell. The first scroll member may include a first end plate defining a first discharge opening and having a first spiral wrap extending from a first surface thereof. The second scroll member may be supported within the shell and may include a second end plate having a second spiral wrap extending therefrom and meshingly engaged with the first spiral wrap. The partition may be fixed to the shell, may overly the first scroll member, and may include a second discharge opening passing therethrough in communication with the first discharge opening. The first annular seal may be sealingly engaged with the first scroll member and the partition to define first and second pressure regions within the shell. The biasing member may be engaged with the first annular seal and may bias the first annular seal into engagement with the partition. The biasing member may include a stop member thereon engaged with the first annular seal to limit a radially inward displacement thereof.

The biasing member may include arms including a radially extending portion having the stop member formed at a radially inner end thereof. The first biasing member may include a generally L-shaped cross-section having a generally radially extending leg and a generally axially extending leg, the stop member limiting radially inward displacement of the radially extending leg. The radially outer end of the radially extending portion may engage the axially extending leg to limit radially inward displacement of the axially extending leg.

The biasing member may additionally include a ring having the stop member formed thereon and leaf springs extending therefrom and engaged with the first scroll member. The ring may include arms extending radially outwardly therefrom and supporting the first annular seal thereon.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
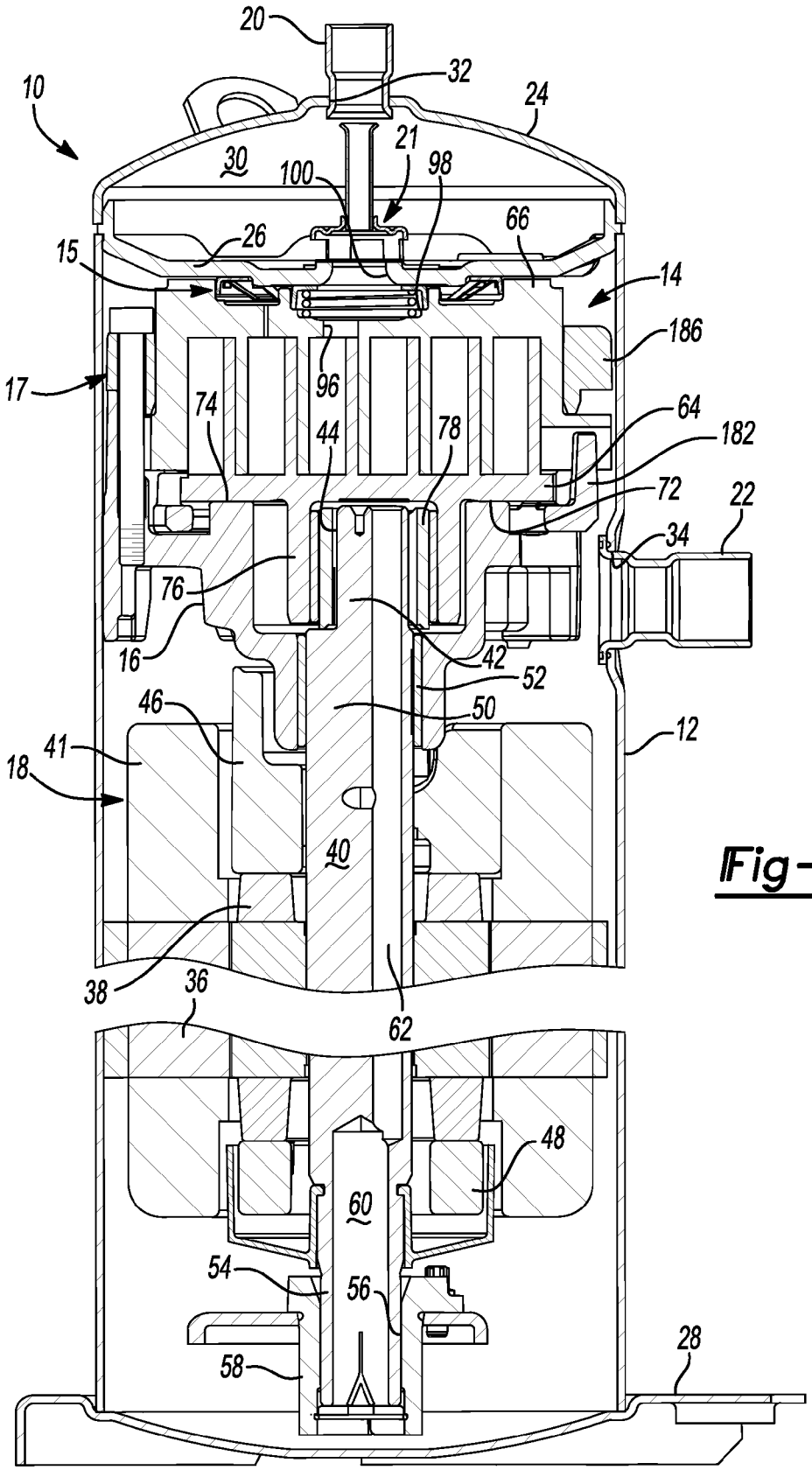
FIG. 1 is a sectional view of a compressor according to the present disclosure.

With reference to FIG. 1, compressor 10 may include a cylindrical hermetic shell 12, a compression mechanism 14, a seal assembly 15, a main bearing housing 16, a retaining assembly 17, a motor assembly 18, a refrigerant discharge fitting 20, a discharge valve assembly 21, and a suction gas inlet fitting 22. Hermetic shell 12 may house compression mechanism 14, main bearing housing 16, and motor assembly 18. Shell 12 may include an end cap 24 at the upper end thereof, a transversely extending partition 26, and a base 28 at a lower end thereof. End cap 24 and transversely extending partition 26 may generally define a discharge chamber 30. Discharge chamber 30 may generally form a discharge muffler for compressor 10. Refrigerant discharge fitting 20 may be attached to shell 12 at opening 32 in end cap 24. Suction gas inlet fitting 22 may be attached to shell 12 at opening 34. Compression mechanism 14 may be driven by motor assembly 18 and supported by main bearing housing 16. Main bearing housing 16 may be affixed to shell 12 at a plurality of points in any desirable manner, such as staking.

Motor assembly 18 may generally include a motor stator 36, a rotor 38, and a drive shaft 40. Windings 41 may pass through stator 36. Motor stator 36 may be press fit into shell 12. Drive shaft 40 may be rotatably driven by rotor 38. Rotor 38 may be press fit on drive shaft 40.

Drive shaft 40 may include an eccentric crank pin 42 having a flat 44 thereon and upper and lower counter-weights 46, 48. Drive shaft 40 may include a first journal portion 50 rotatably journaled in a first bearing 52 in main bearing housing 16 and a second journal portion 54 rotatably journaled in a second bearing 56 in lower bearing housing 58. Drive shaft 40 may include an oil-pumping concentric bore 60 at a lower end. Concentric bore 60 may communicate with a radially outwardly inclined and relatively smaller diameter bore 62 extending to the upper end of drive shaft 40. The lower interior portion of shell 12 may be filled with lubricating oil. Concentric bore 60 may provide pump action in conjunction with bore 62 to distribute lubricating fluid to various portions of compressor 10.

Figure 2:
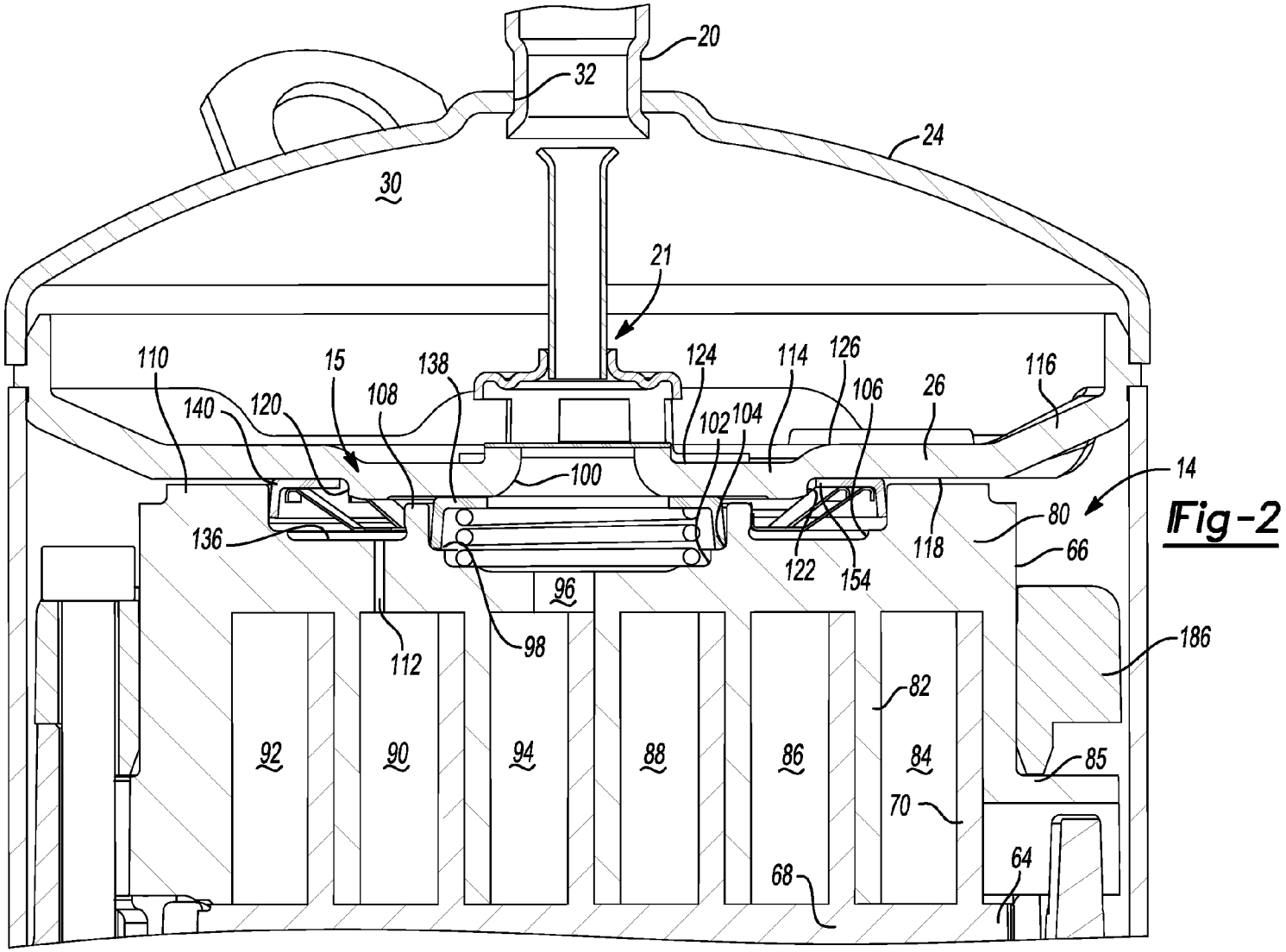
FIG. 2 is a fragmentary section view of the compressor of FIG. 1.

With additional reference to FIG. 2, compression mechanism 14 may generally include an orbiting scroll 64 and a non-orbiting scroll 66. Orbiting scroll 64 may include an end plate 68 having a spiral vane or wrap 70 on the upper surface thereof and an annular flat thrust surface 72 on the lower surface. Thrust surface 72 may interface with an annular flat thrust bearing surface 74 on an upper surface of main bearing housing 16. A cylindrical hub 76 may project downwardly from thrust surface 72 and may have a drive bushing 78 rotatively disposed therein. Drive bushing 78 may include an inner bore in which crank pin 42 is drivingly disposed. Crank pin flat 44 may drivingly engage a flat surface in a portion of the inner bore of drive bushing 78 to provide a radially compliant driving arrangement.

Non-orbiting scroll 66 may include an end plate 80 having a spiral wrap 82 on a lower surface thereof. Spiral wrap 82 may form a meshing engagement with wrap 70 of orbiting scroll 64, thereby creating an inlet pocket 84, intermediate pockets 86, 88, 90, 92, and an outlet pocket 94. Non-orbiting scroll 66 may be axially displaceable relative to main bearing housing 16, shell 12, and orbiting scroll 64. Non-orbiting scroll 66 may include a housing 67 generally surrounding spiral wrap 82.

Housing 67 may include a radially outwardly extending flange 85 defining a radially outwardly extending protrusion to limit axial displacement of non-orbiting scroll 66 relative to main bearing housing 16, as discussed below. Flange 85 may be located at an end of housing 67 that is distal from end plate 80.

Non-orbiting scroll 66 may include a discharge passageway 96 in communication with outlet pocket 94 and upwardly open recess 98 which may be in fluid communication with discharge chamber 30 via an opening 100 in partition 26. Recess 98 may include first and second portions 102, 104. First portion 102 may have a cross-sectional area that is less than the cross-sectional area of second portion 104. Discharge passageway 96 may be offset relative to a center of recess 98.

Non-orbiting scroll 66 may include an annular recess 106 in the upper surface thereof defined by parallel coaxial inner and outer side walls 108, 110. Outer side wall 110 may have an axial extent that is greater than the axial extent of inner side wall 108. Annular recess 106 may provide for axial biasing of non-orbiting scroll 66 relative to orbiting scroll 64, as discussed below. More specifically, a passage 112 may extend through end plate 80 of non-orbiting scroll 66, placing recess 106 in fluid communication with intermediate pocket 90. While passage 112 is shown extending into intermediate pocket 90, it is understood that passage 112 may alternatively be placed in communication with any of the other intermediate pockets 86, 88, 92.

Retaining assembly 17 may include an Oldham coupling 182 and a retaining ring 186, as described in "Compressor with Retaining Mechanism", filed Sep. 9, 2008, U.S. application Ser. No. 12/207,072, the disclosure of which is incorporated herein by reference. Oldham coupling 182 may be engaged with orbiting and non-orbiting scrolls 64, 66 to prevent relative rotation therebetween. Retaining ring 186 may limit axial displacement of non-orbiting scroll 66 relative to main bearing housing 16. Discharge valve assembly 21 may generally prevent a reverse flow of fluid during compressor shut-down, as described in, "Compressor Having a Shutdown Valve", filed Sep. 9, 2008, U.S. application Ser. No. 12/207,089, the disclosure of which is incorporated herein by reference.

Figure 3:
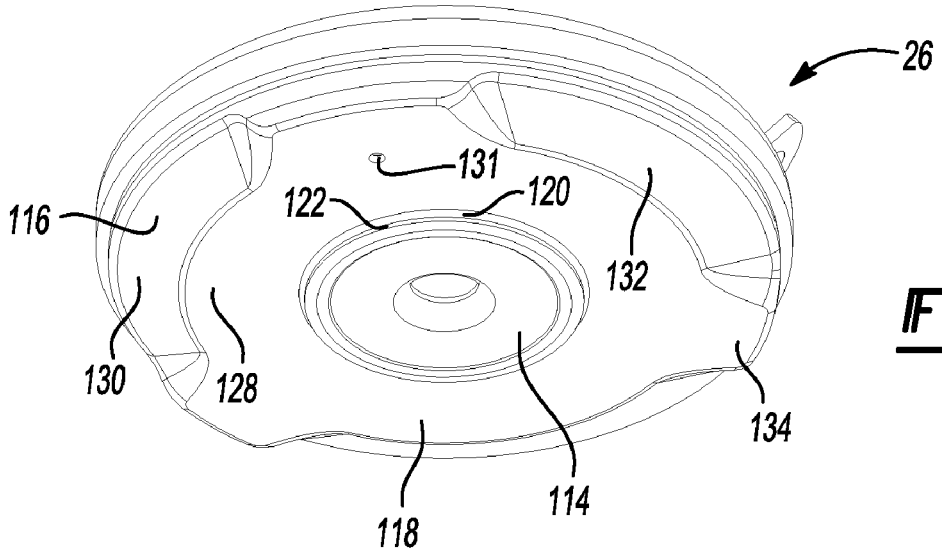
FIG. 3 is a perspective view of the partition of the compressor of FIG. 1.

Partition 26 may be located between non-orbiting scroll 66 and end cap 24. With reference to FIGS. 2 and 3, partition 26 may include a generally curved body having first and second portions 114, 116. First portion 114 may be generally planar and may be disposed radially inwardly relative to second portion 116. First portion 114 may extend axially outwardly from a lower surface 118 of partition 26 toward non-orbiting scroll 66 relative to second portion 116, forming a protrusion, or step 120 including an axially outwardly extending wall 122 at a perimeter thereof. Step 120 may extend axially beyond outer side wall 110. First portion 114 may therefore form a recess 124 in an upper surface 126 of partition 26. Opening 100 may extend through first portion 114.

Second portion 116 may include first and second sections 128, 130. First section 128 may be generally planar and may extend radially outwardly from first portion 114. Second section 130 may extend radially outwardly from first section 128. Second section 130 may include a series of portions 132 extending at an angle upwardly relative to first section 128 and non-orbiting scroll 66. Portions 132 may be separated by a series of planar portions 134. Second section 130 may include an aperture 131 therein for coupling an overheat protection device (not shown) thereto. Second portion 116 may define an outer circumference of partition 26.

First portion 114 may extend radially outwardly from opening 100 to a location radially between inner and outer side walls 108, 110. Second portion 116 may extend radially outwardly from an outer circumference of end plate 80 of non-orbiting scroll 66. Seal assembly 15 may engage partition 26 to create an annular chamber 136 that is isolated from suction and discharge pressure during normal operation of compressor 10.

Figure 4:
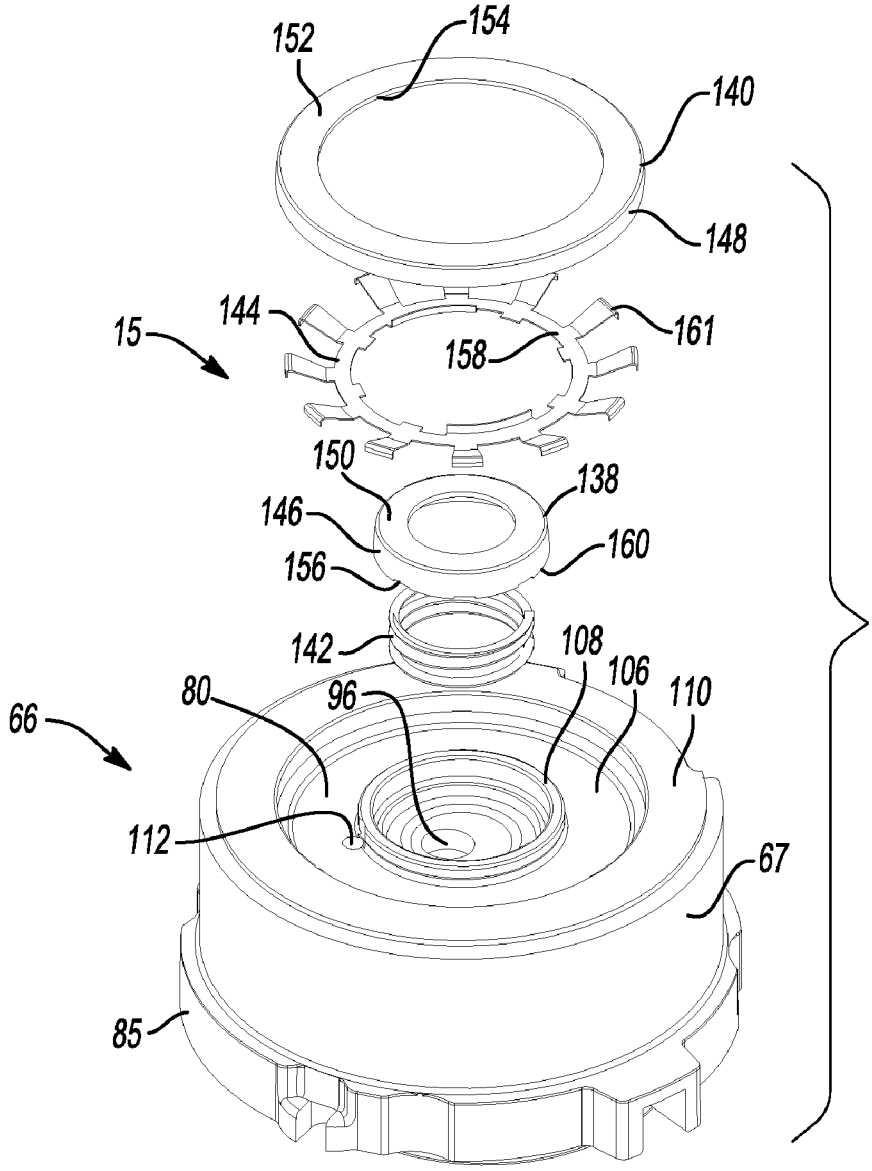
FIG. 4 is an exploded perspective view of the non-orbiting scroll and sealing assembly of FIG. 1.

With reference to FIGS. 1, 2, and 4, seal assembly 15 may include first and second seals 138, 140 and first and second biasing members 142, 144. First and second seals 138, 140 may each engage partition 26 and non-orbiting scroll 66. First and second seals 138, 140 may each include an L-shaped cross-section with a first leg 146, 148 and a second leg 150, 152. First seal 138 may be disposed in recess 98. First leg 146 of first seal 138 may sealingly engage a radially inner surface of inner side wall 108 and second leg 150 of first seal 138 may sealingly engage lower surface 118 of partition 26 at first portion 114 during normal compressor operation to form a sealed discharge passage between discharge passageway 96 and opening 100. The sealed discharge passage may generally form a first pressure region of shell 12 operating at a discharge pressure.

Second seal 140 may be disposed in recess 106. First leg 148 of second seal 140 may sealingly engage a radially inner surface of outer side wall 110 and second leg 152 of second seal 140 may sealingly engage lower surface 118 of partition 26 at second portion 116 during normal compressor operation to form second and third pressure regions. More specifically, the second pressure region may generally form a suction pressure region of shell 12 operating at a suction pressure and the third pressure region may generally form an intermediate pressure region operating at an intermediate pressure between the suction and discharge pressures. The third pressure region may include annular chamber 136 and may generally surround and be located radially outwardly from the first pressure region. The second pressure region may be located in a region of shell 12 external to both the first and third pressure regions.

First seal 138 may include recesses 156 in first leg 146. Recesses 156 may generally form a fluid communication passage in first seal 138. Recesses 156 may extend into end 160 of first leg 146. Under normal operating conditions, pressure within recess 106 (third pressure region at intermediate pressure) may be less than pressure within recess 98 (first pressure region at discharge pressure). Under a reverse pressure condition, where pressure within recess 106 is greater than pressure within recess 98, first seal 138 may be urged radially inwardly by the pressure differential, resulting in first leg 146 being partially displaced from sealing engagement with inner side wall 108.

Recesses 156 may be in communication with recess 98 during normal compressor operation and during reverse pressure conditions. Recesses 156 may be isolated from communication with recess 106 during normal compressor operation through sealing engagement between first leg 146 and non-orbiting scroll 66. When first leg 146 is displaced during reverse pressure conditions, recesses 156 may generally be in communication with recess 98 to provide fluid communication between recess 106 and recess 98. The fluid communication between recesses 98, 106 provided by recesses 156 of first seal 138 may generally provide pressure equalization between recesses 98, 106 to prevent buckling of first leg 146 of first seal 138 during reverse pressure conditions. An axial distance between inner side wall 108 and partition 26 may be less than an axial thickness of second leg 150 of first seal 138, preventing radially outward displacement of first seal 138 beyond inner side wall 108.

Second seal 140 may generally surround step 120. First leg 148 of second seal 140 may extend longitudinally between non-orbiting scroll member 66 and partition 26. Second leg 152 may extend radially inwardly from an end of first leg 148 proximate partition 26. An axial distance between outer side wall 110 and partition 26 may be less than an axial thickness of second leg 152, preventing radially outward displacement of second seal 140 beyond outer side wall 110. An end 154 of second leg 152 may engage wall 122 of partition 26, limiting radially inward movement of second leg 152 of second seal 140.

First biasing member 142 may include a compression spring disposed within recess 98. First biasing member 142 may extend between end plate 80 of non-orbiting scroll 66 and partition 26. Second leg 150 of first seal 138 may be disposed between first biasing member 142 and partition 26, resulting in first biasing member 142 urging first seal 138 into engagement with partition 26, providing sealed engagement therebetween during compressor start-up.

Second biasing member 144 may include a central ring 158 having a series of leaf springs 161 extending therefrom. Second biasing member 144 may be disposed in recess 106 and may extend between end plate 80 of non-orbiting scroll 66 and partition 26. First leg 148 of second seal 140 may be disposed between second biasing member 144 and the radially inner surface of outer side wall 110. Second leg 152 of second seal 140 may be disposed between second biasing member 144 and partition 26. More specifically, leaf springs 161 may generally urge first leg 148 into engagement with outer side wall 110 and second leg 152 into engagement with partition 26, providing sealed engagement therebetween during compressor start-up. Second biasing member 144 may additionally inhibit flattening out of second seal 140.

Figure 5:
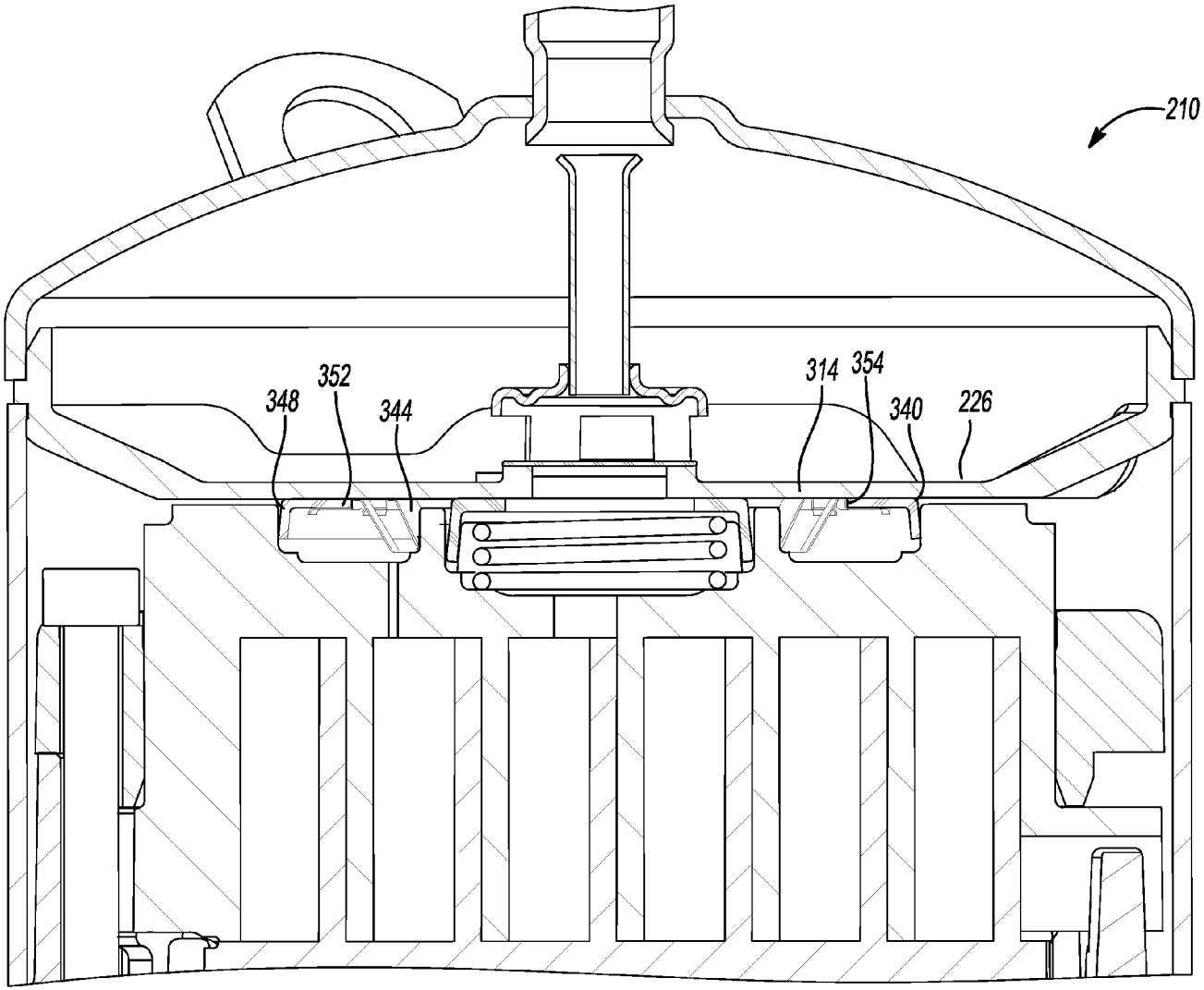
FIG. 5 is a fragmentary section view of an alternate compressor according to the present disclosure.
Figure 6:
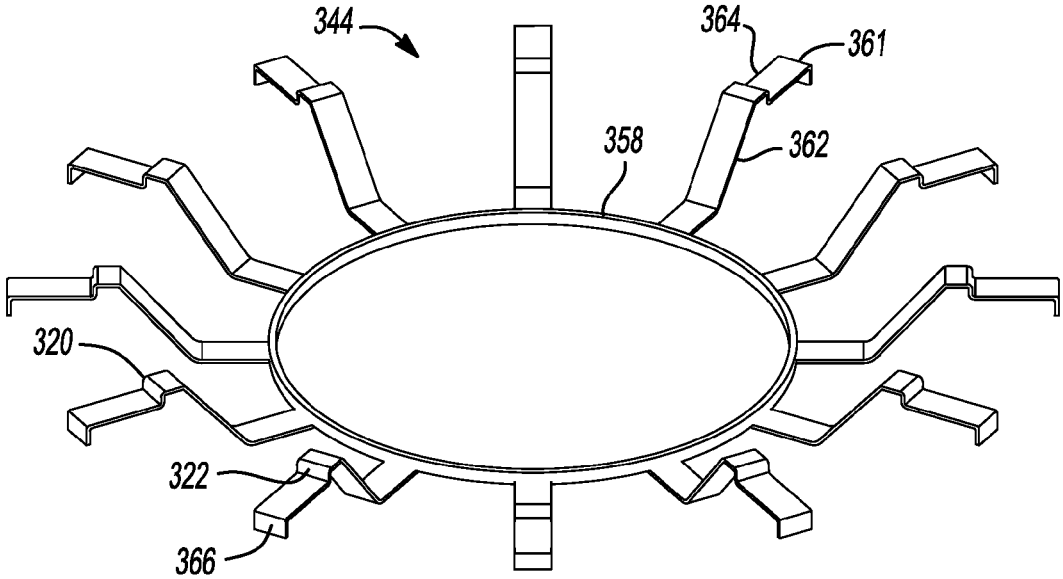
FIG. 6 is a perspective view of an alternate spring of the compressor of FIG. 5.

With reference to FIG. 5, an alternate compressor 210 may be generally similar to compressor 10, with the exception of partition 226 and second biasing member 344. Partition 226 may be generally similar to partition 26, with the exception of first portion 314. Rather than forming a step 120 as in partition 26, first portion 314 of partition 226 may be generally planar. With additional reference to FIG. 6, second biasing member 344 may form a step 320 that generally performs the same function as step 120.

Second biasing member 344 may include a central ring 358 having a series of leaf springs 361 extending therefrom. Leaf springs 361 may include first portions 362 extending at an angle from central ring 358 and second portions 364 extending from ends of first portions 362. Second portions 364 may extend radially outwardly from first portions 362 and may be generally parallel to first portion 314 of partition 226.

Second portion 364 may include step 320 at a radially inner portion thereof. A radially outer end 366 of second portion 364 may engage first leg 348 of second seal 340, limiting radially inward displacement thereof. Step 320 may generally form a stop member to limit radially inward displacement of second leg 352 of second seal 340. More specifically, end 354 of second leg 352 may engage a wall 322 formed by step 320, limiting radially inward movement of second leg 352 of second seal 340.

Figure 7:
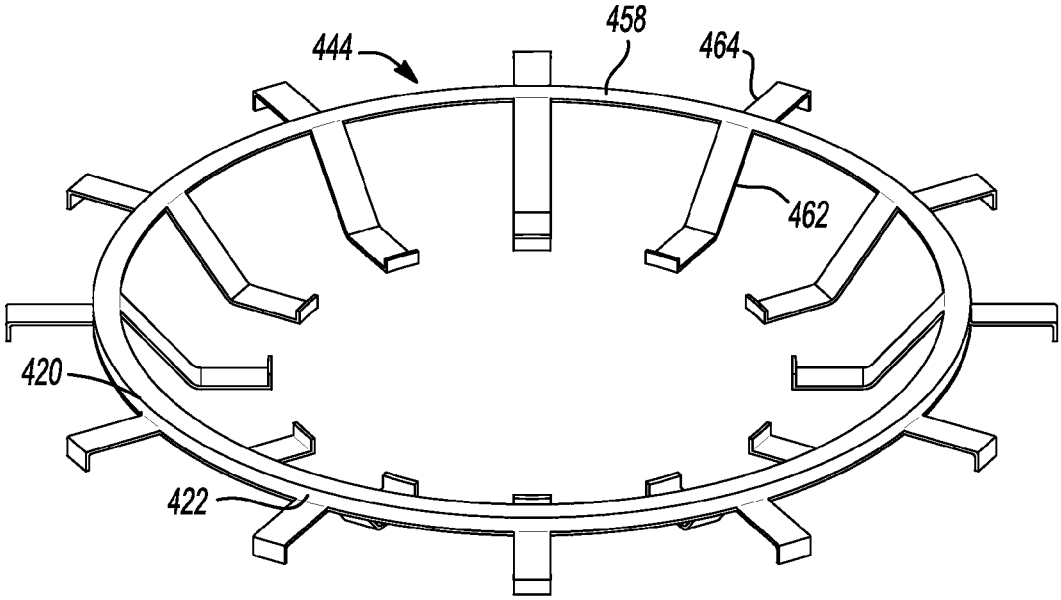
FIG. 7 is a perspective view of an alternate spring.

Alternatively, compressor 210 may include a second biasing member 444, as seen in FIG. 7. Second biasing member 444 may be generally similar to second biasing member 344, with the exception of central ring 358. Second biasing member 444 may include a central ring 458 and first and second leaf springs 462, 464. First leaf spring 462 may extend radially inwardly from central ring 458 and second leaf spring (or arm) 464 may extend radially outwardly from central ring 458. First and second leaf springs 462, 464 may be generally similar to first and second portions 362, 364 of leaf spring 361, with the exception of step 420 being formed on central ring 458.

Central ring 458 may form a step 420 that performs the same function as step 120, 320. Step 420 may form a generally continuous annular wall 422 to limit radially inward displacement of a seal, such as second seal 340 in FIG. 5. More specifically, an end of a seal, such as end 354 of second seal 340 may engage wall 422 to limit radially inward displacement thereof.

Figure 8:
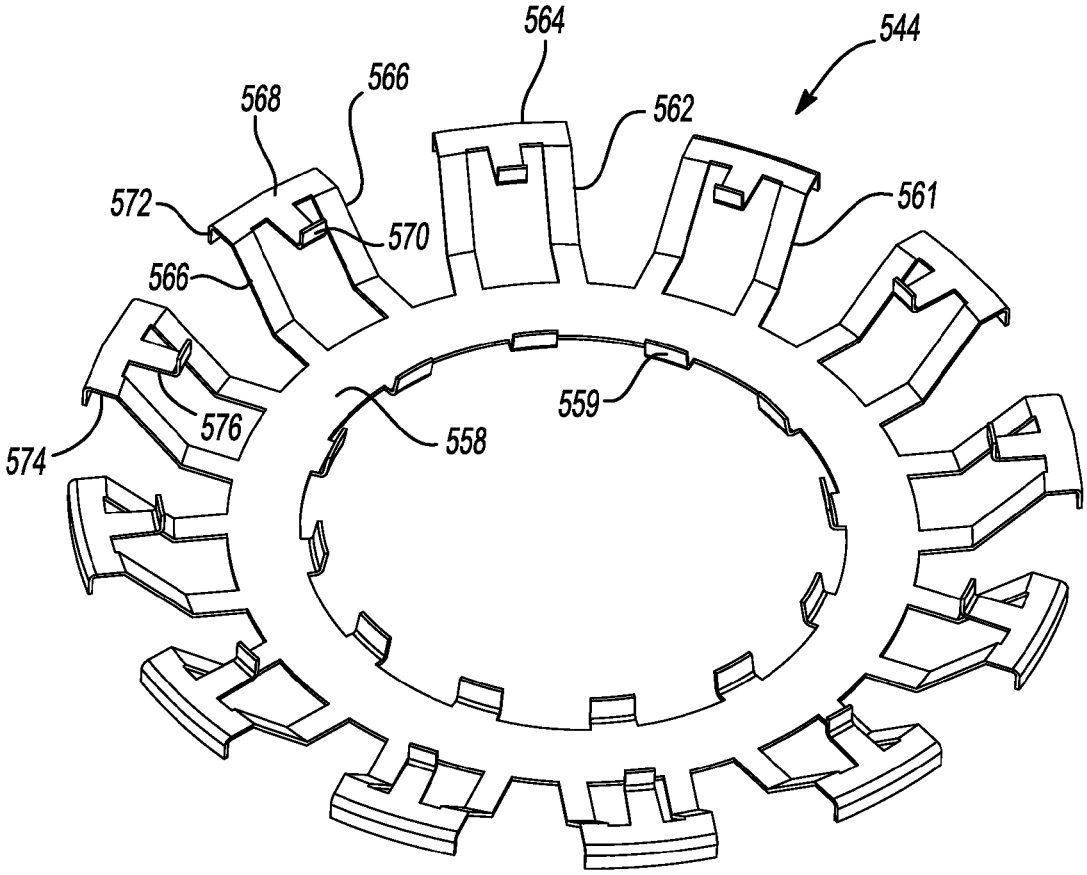
FIG. 8 is a perspective view of an alternate spring.

Alternatively, compressor 210 may include a second biasing member 544, as seen in FIG. 8. Second biasing member 544 may include a central ring 558 having a series of leaf springs 561 extending therefrom. Central ring 558 may include a series of protrusions 559 extending axially upward from an inner radial portion of central ring 558. Leaf springs 561 may extend axially and radially outward from central ring 558.

Leaf springs 561 may include first and second portions 562, 564. First portion 562 may include a pair of arms 566 extending axially and radially outward from central ring 558. Arms 566 may be spaced from one another and may each include a first end fixed to central ring 558 and a second end having second portion 564 fixed thereto. Second portion 564 may include a radial seal support surface 568 and first and second seal stops 570, 572. Seal support surface 568 may include a main body portion 574 extending between arms 566 and a support member 576 extending radially inward from main body portion 574 and circumferentially between arms 566. First stop 570 may extend axially upward from a radially inner end of support member 576 and may limit radially inward displacement of a seal, such as second seal 340 shown in FIG. 5. Second stop 572 may extend axially downward from a radially outer end of main body portion 574.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a first scroll member supported within said shell for axial displacement relative to said shell, said first scroll member including a first end plate defining a first discharge opening and having a first spiral wrap extending from a first surface thereof;

a second scroll member supported within said shell and including a second end plate having a second spiral wrap extending therefrom and meshingly engaged with said first spiral wrap;

a partition fixed to said shell and overlying said first scroll member, said partition including first and second sides having a second discharge opening passing therethrough and being in communication with said first discharge opening, said first side generally facing said first scroll member and including a protrusion extending toward said first scroll member and generally surrounding said second discharge opening; and a first annular seal having a generally L-shaped cross-section including first and second legs, said first leg extending longitudinally between said first scroll member and said partition longitudinally beyond said protrusion on said partition and sealingly engaged with said first scroll member and said second leg extending radially inward from said first leg and sealingly engaged with said first side of said partition to define first and second pressure regions within said shell, said first annular seal generally surrounding and disposed radially outwardly relative to said protrusion on said partition and displaceable to a position abutting said protrusion, said protrusion limiting a radially inward travel of said first annular seal.

2. The compressor of claim 1, wherein said first scroll member includes a second surface generally opposite said first surface including a recess formed therein, said recess including an outer wall generally surrounding said protrusion on said partition and engaged with a radially outer portion of said first leg of said first annular seal.

3. The compressor of claim 2, wherein said first leg is sealingly engaged with said outer wall of said recess.

4. The compressor of claim 3, wherein said second leg includes a free end engaged with said protrusion when said second leg is displaced radially inwardly.

5. The compressor of claim 1, wherein said first pressure region is located radially outwardly from and generally surrounds said second pressure region.

6. The compressor of claim 1, wherein said first pressure region includes a suction pressure region of said shell.

7. The compressor of claim 1, wherein said second pressure region includes an intermediate pressure region operating at a pressure between an operating pressure of a suction pressure region and an operating pressure of a discharge pressure region within said shell.

8. The compressor of claim 1, further comprising a second annular seal disposed radially inwardly relative to said first annular seal and sealingly engaged with said first scroll member and said first side of said partition to define a third pressure region.

9. The compressor of claim 8, wherein said third pressure region includes a discharge pressure region of said shell.

10. A compressor comprising:

a shell;

a first scroll member supported within said shell and including a first end plate defining a first discharge opening and having a first spiral wrap extending from a first surface thereof;

a second scroll member supported within said shell and including a second end plate having a second spiral wrap extending therefrom and meshingly engaged with said first spiral wrap;

a partition fixed to said shell and overlying said first scroll member, said partition including a second discharge opening in communication with said first discharge opening; and a first annular seal to seal first and second pressure regions of said shell from communication with one another, said first annular seal having a generally L-shaped cross-section including a first portion extending radially inward from a second portion and sealingly engaged with said partition and said second portion extending longitudinally between said first scroll member and said partition longitudinally beyond said protrusion on said partition, engaged with said first scroll member and including a fluid communication passage in communication with said first pressure region, said second portion being displaceable between first and second positions, said second portion being sealingly engaged with said first scroll member to seal said first pressure region from communication with said second pressure region when in said first position and said second portion being displaced relative to said first scroll member when in said second position to provide fluid communication between said fluid communication passage and said second pressure region.

11. The compressor of claim 10, wherein said fluid communication passage is isolated from said second pressure region when said second portion of said seal is in said first position.

12. The compressor of claim 11, wherein said second portion of said first annular seal sealingly engages a wall formed on said first scroll member generally surrounding said first pressure region to isolate said fluid communication passage from said second pressure region.

13. The compressor of claim 10, wherein said fluid communication passage in said first annular seal includes a recess formed in an end of said second portion proximate said first scroll member.

14. The compressor of claim 10, wherein said fluid communication passage provides fluid communication between said first and second pressure regions when said second portion of said first annular seal is in said second position.

15. The compressor of claim 10, wherein said first position generally corresponds to a first operating condition where an operating pressure within said second pressure region is less than an operating pressure within said first pressure region.

16. The compressor of claim 10, wherein said second position generally corresponds to a second operating condition where an operating pressure within said second pressure region is greater than an operating pressure within said first pressure region.

17. The compressor of claim 10, wherein said second pressure region is located radially outwardly from and generally surrounds said first pressure region.

18. The compressor of claim 10, wherein said first pressure region includes a discharge passage defined between said first and second discharge openings.

19. The compressor of claim 18, wherein said second pressure region includes a region of said shell external to said discharge passage.

20. The compressor of claim 10, wherein said second pressure region includes an intermediate pressure region operating at a pressure between an operating pressure of a suction pressure region and an operating pressure of a discharge pressure region within said shell.

21. The compressor of claim 10, further comprising a second annular seal disposed radially outwardly relative to said first annular seal to seal a third pressure region of said shell from communication with said second pressure region.

22. The compressor of claim 21, wherein said third pressure region includes a suction pressure region of said shell.

23. A compressor comprising:

a shell;

a first scroll member supported within said shell for axial displacement relative to said shell, said first scroll member including a first end plate defining a first discharge opening and having a first spiral wrap extending from a first surface thereof;

a second scroll member supported within said shell and including a second end plate having a second spiral wrap extending therefrom and meshingly engaged with said first spiral wrap;

a partition fixed to said shell and overlying said first scroll member and including a second discharge opening passing therethrough in communication with said first discharge opening;

a first annular seal sealingly engaged with said first scroll member and said partition to define first and second pressure regions within said shell; and a biasing member engaged with said first annular seal and biasing said first annular seal into engagement with said partition, said biasing member including a stop member thereon engaged with said first annular seal to limit a radially inward displacement thereof.

24. The compressor of claim 23, wherein said biasing member includes arms including a radially extending portion having said stop member formed at a radially inner end thereof.

25. The compressor of claim 24, wherein said first biasing member includes a generally L-shaped cross-section having a generally radially extending leg and a generally axially extending leg, said stop member limiting radially inward displacement of said radially extending leg.

26. The compressor of claim 25, wherein a radially outer end of said radially extending portion engages said axially extending leg to limit radially inward displacement of said axially extending leg.

27. The compressor of claim 23, wherein said biasing member includes a ring having said stop member formed thereon and leaf springs extending therefrom and engaged with said first scroll member.

28. The compressor of claim 27, wherein said ring includes arms extending radially outwardly therefrom and supporting said first annular seal thereon.

* * * * *

UNITED STATES PATENT AND TRADEMARK OFFICE

CERTIFICATE OF CORRECTION

PATENT NO. : 8,043,078 B2
APPLICATION NO. : 12/207051
DATED : October 25, 2011
INVENTOR(S) : Robert C. Stover et al.

It is certified that error appears in the above-identified patent and that said Letters Patent is hereby corrected as shown below:

Title Page, item (60),
Related U.S. Application Data should read: --Provisional Application Nos. 60/993,451, 60,993,452, 60/993,464 and 60/993,465, each filed September 11, 2007 and Provisional Application No. 61/038,162, filed March 20, 2008.--

Signed and Sealed this
Twentieth Day of March, 2012

David J. Kappos

David J. Kappos
*Director of the United States Patent and Trademark Office*